US005542303A

United States Patent [19]

Neuffer

[11] Patent Number: 5,542,303

[45] Date of Patent: Aug. 6, 1996

[54] DUAL-PEAK TORQUE MEASURING APPARATUS

[76] Inventor: A. Erich Neuffer, 5462 Territorial Rd., Grand Blanc, Mich. 48439

[21] Appl. No.: 241,643

[22] Filed: May 12, 1994

[51] Int. Cl.[6] ..... B25B 23/00

[52] U.S. Cl. ..... 73/862.23

[58] Field of Search ..... 73/862.08, 862.21, 73/862.23

[56] References Cited

U.S. PATENT DOCUMENTS

| | | | |
|---|---|---|---|
| 3,263,171 | 7/1966 | Josias . | |
| 3,310,739 | 3/1967 | Medlar . | |
| 4,006,629 | 2/1977 | Barrett et al. . | |
| 4,013,895 | 3/1977 | Akiyoshi et al. . | |
| 4,125,016 | 11/1978 | Lehoczky et al. | 73/862.23 |
| 4,319,494 | 3/1982 | Marcinkiewicz . | |
| 4,426,887 | 1/1984 | Reinholm et al. . | |
| 4,450,727 | 5/1984 | Reinholm et al. . | |
| 4,558,601 | 12/1985 | Stasiek et al. | 73/862.23 |
| 4,643,030 | 2/1987 | Becker et al. | 73/862.33 |
| 4,715,211 | 12/1987 | Leboczky . | |
| 4,894,767 | 1/1990 | Doniwa . | |
| 4,987,806 | 1/1991 | Lehnert . | |
| 5,115,701 | 5/1992 | Lehnert . | |
| 5,204,613 | 4/1993 | Cripps et al. . | |

OTHER PUBLICATIONS

4–page brochure entitled "Model 845 Process Analyzer Transient Recorder".

3–page brochure entitled "Data–Tork Hand Torque Wrench".

4–page brochure entitled "Data–Stat Torque Auditing System" published in 1989.

6–page brochure entitled "290 Data Stat Torque Monitoring and Data Collection Instrument".

2–page advertisement entitled "Modular Transducer Instrumentation".

*Primary Examiner*—Richard Chilcot
*Assistant Examiner*—Ronald Biegel
*Attorney, Agent, or Firm*—Weintraub DuRoss & Brady

[57] ABSTRACT

A torque measuring device has the capability of measuring torque in either a clockwise or counter-clockwise direction. The device has a dual peak circuit, which allows the measuring to be effected without physical alteration of the device.

10 Claims, 2 Drawing Sheets

FIG 2
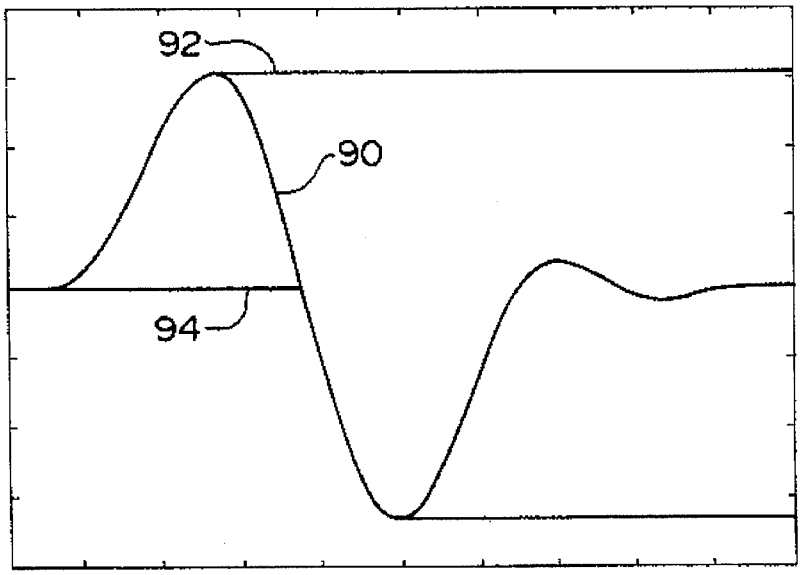
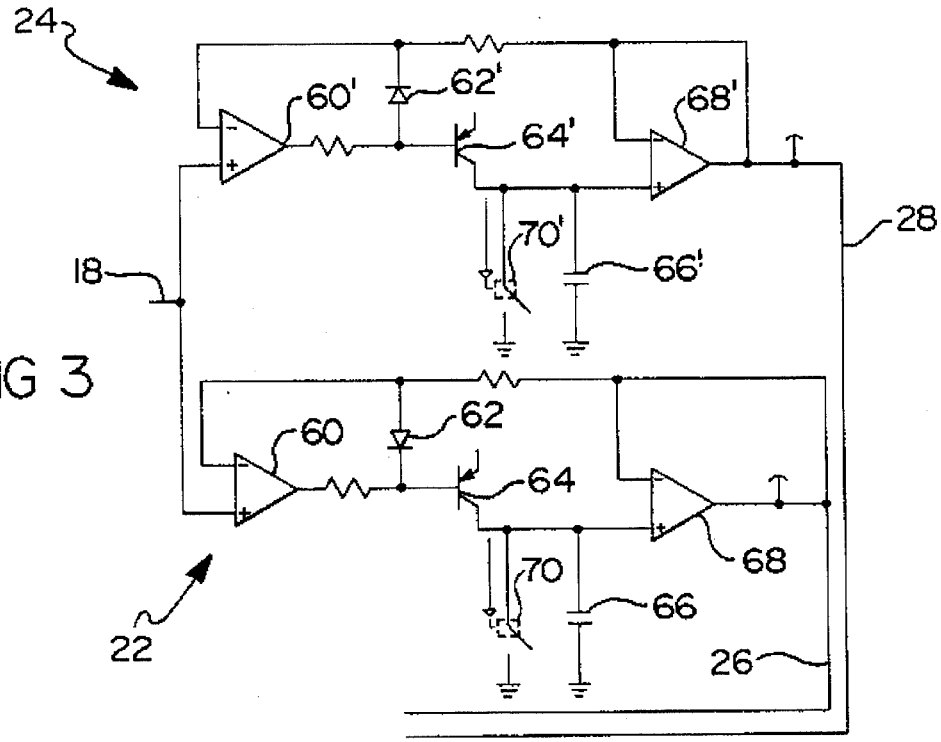
FIG 3
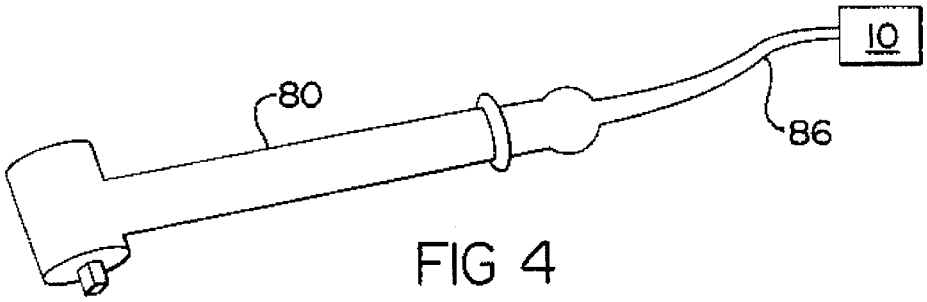
FIG 4

DUAL-PEAK TORQUE MEASURING APPARATUS

BACKGROUND OF THE INVENTION

1. Field of the Invention

The present invention concerns torque measuring devices. More particularly, the present invention concerns devices that can measure torque as it is being applied to a joint, independent of the direction of fastening of the joint. Even more particularly, the present invention concerns devices that measure torque that is either being currently applied to a joint or that has been previously applied to the joint.

2. Description of the Prior Art

Heretofore, it has been desired, in fact required, to ensure that a pre-determined amount of torque be applied to a fastener. This occurs in many manufacturing applications, where the torque applied to a bolt or plurality of fasteners must be within set tolerances. Failure to maintain the torque applied within those values can result in improper joints being formed, with instability inherent therein. It therefore became desirable to test the torque previously applied to a joint after tightening had been effected.

One attempt to address this problem is found in U.S. Pat. Nos. 4,244,213 and 4,319,494 issued to Marcinkiewicz, and both of which are herein incorporated by reference. Marcinkiewicz teaches broadly the concept of recording the changes in the slope of the torque applied to a nut. The advantage in a system of this type is that it allows a testing of the torque previously applied to a joint, to ensure that the joint has the proper tension. Such testing is termed auditing or retorquing.

The devices of the Marcinkiewicz patents are especially set to observe the negative valley torque, which occurs after the breakaway. Marcinkiewicz utilized a microprocessor to record these values and display a resulting value. By this method, the joint effected can be tested without the need of unfastening the joint, which previously was the case. Unfortunately, spikes due to interference or operator error give false results, which can nullify the data recorded.

The problem associated electrical "spikes" which can disrupt data in such auditing instruments was partially addressed in U.S. Pat. No. 4,450,727, issued to Reinholm et alia and incorporated herein by reference. Reinholm et alia builds upon the prior art to control a window of readings for the device. The device of Reinholm measures the changes in the slope of two "endpoints" of the torque signal being applied to the nut. This allows the sensing of the breakaway torque by denoting a slope of a minimum value. When this value is achieved, the breakaway torque has been realized and the reading of signals is halted. This gives a purity to the data collected and a more accurate reading.

As helpful as these advances are, these devices are directed to the auditing of torque previously applied to a joint. There exists a need for a device that can accurately monitor the application of torque to a joint during the application thereof, a need that these devices do not address. Further, there is a need for a device that can both monitor the torque as it is being applied and is capable of auditing the torque after it has been applied.

There also exists a need in the art for a device that is capable of reading torque as it is being applied to a joint independent of the direction of fastening of the joint. There exist applications, such as the construction of fire extinguishers and some medical equipment, that have multiple joints, some of which are clockwise tightened joints and some being counter-clockwise tightened joints. There currently exists no device to either monitor the torque to joints of differing fastening direction, either as it is applied or after it has been applied, without altering and recalibrating the equipment. Thus, there is needed a device which, without alteration, may determine the torque applied to a fastener while either rotating clockwise or counter-clockwise.

It is to these needs that the present invention is directed.

SUMMARY OF THE INVENTION

The present invention comprises a torque measuring device utilizing a dual peak circuit to enable the measurement of torque applied to a fastener in either a clockwise direction or a counter-clockwise direction. Broadly speaking, this invention concerns a digital analysis scheme utilizing a central processing unit to sample and store signals from the detectors. More specifically, the present invention comprises a dual peak circuit. The dual peak circuit comprises the means by which signals of either direction, that is, clockwise or counter-clockwise, are measured. Thus, torque is measured as it is being applied to the joint, regardless of the direction of the fastener.

The present invention is an apparatus for measuring the peak value of the torque being applied to a joint, the apparatus comprising:

(a) a transducer to provide an analog signal corresponding to the amount of torque being applied to a fastener in the joint;

(b) a dual peak detector to determine the maximum torque being applied to the fastener regardless of the direction of the fastening;

(c) a converter to change the signal from analog to digital;

(d) means for storing the peak values; and (e) means for displaying the peak values.

The present invention also comprises a method of determining the peak value of torque applied to a joint regardless of the direction of fastening of the joint. The method of the present invention comprises the steps of:

(a) generating an analog signal representing the torque being applied to the joint;

(b) determining the peak value of the torque being applied to the joint by passing the analog signal through a dual peak detection circuit;

(c) converting the analog peak values determined into digital values;

(d) storing the digital values in means for storing; and (e) displaying the digital values on means for displaying.

It is noted that, in an alternate embodiment, the present invention may further comprise means for auditing the torque previously applied to a joint, effecting a device that can both analyze torque while it is being applied and after the torque has been applied.

The present invention will be better understood with reference to the following detailed description and the accompanying drawings, in which like reference numbers refer to like elements, and in which:

BRIEF DESCRIPTION OF THE DRAWINGS

FIG. 2 is a graphic representation of the electrical signals of the torque curve and the dual peak circuits as the torque is measured;

FIG. 3 is a circuit diagram of the dual peak detector circuit of the present invention; and FIG. 4 is a perspective view of the present invention attached to a fastening device.

DETAILED DESCRIPTION OF THE PREFERRED EMBODIMENT

Figure 1:
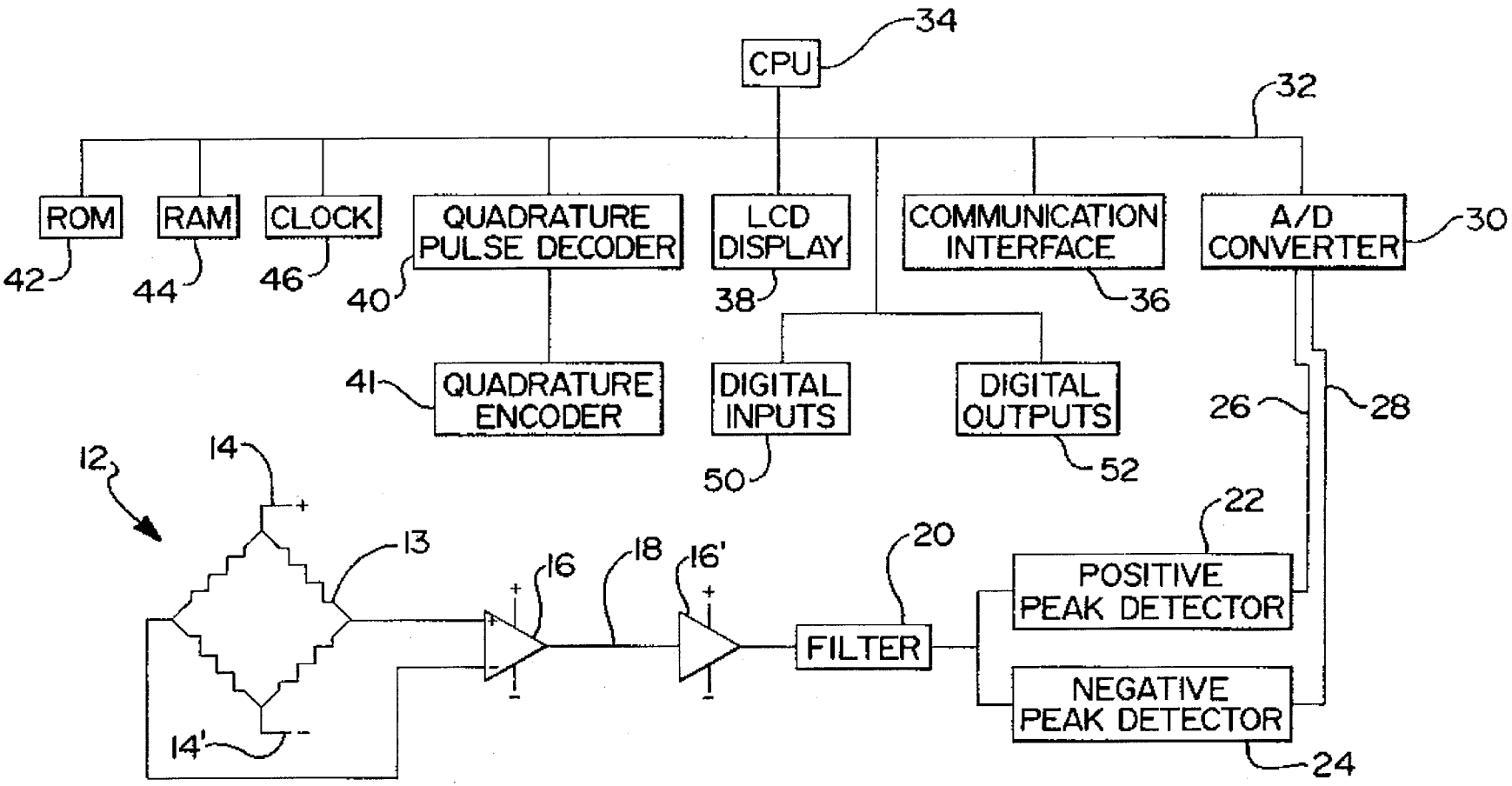
FIG. 1 is a block diagram of the dual peak detection apparatus of the present invention.

Referring to FIGS. 1–4, there is shown the present invention, to wit, a dual peak circuit 10. The circuit 10 comprises a transducer 12, a plurality of amplifiers 16, 16', a dual peak circuit 22, 24, an analog-to-digital converter 30, a central processing unit 34 and means for displaying 38.

The transducer 12 of the present invention comprises a whetstone bridge 13 in electrical connection with a plurality of strain gauges connected to leads 14, 14'. The gauges may be selected from among those commonly known and available in the art. The critical feature to appreciate is that the whetstone bridge 13 will experience the torque and produce analog signals from this torquing action, which is simultaneously occurring at the joint, such that an analog signal corresponding to the magnitude of that torque can be generated and passed to the amplifier 16.

The input signal so produced is then amplified and filtered, so that a clearer and cleaner single-ended signal 18 may be analyzed by the peak circuitry. The amplifiers 16, 16' and filter 20 are commonly known in the art. The single-ended signal 18 is then fed to the dual peak circuit.

Referring now to FIG. 3, the dual peak circuit is seen comprising the positive peak portion 22 and the negative peak portion 24. Both portions 22, 24 of the circuit receive the input torque signal along line 18. The operation of each portion 22, 24 of the dual peak circuit is identical, save that the diodes 62, 64 of the positive peak circuit portion 22 are set polarly opposite to those diodes 62', 64' of the negative peak circuit portion 24. Therefore, only the positive peak circuit portion 22 will be discussed in detail, with the discussion being understood to be applied to the negative peak circuit portion 24.

It is noted that the diodes 64, 64' comprise a low leakage transistor, which acts as a diode. It is displayed as a preferred selection of a design element; however, other similar and equivalent devices can be elected, as desired.

A buffer 60 is deployed in the positive peak circuit portion 22 of the peak circuit to receive the signal 18 and feed that signal 18 through the diodes 62, 64 deployed therein. Each diode 62, 64 is configured specifically; that is, the positive peak circuit portion 22 will only permit the signal 18 to pass through its diodes 62, 64 if the signal 18 is positive and the negative peak circuit portion 24 will only permit the signal 18 to pass its diode 62', 64' if the signal 18 is negative. By this deployment of diodes 62, 62', 64, 64', the circuit can evaluate signals of either clockwise or counter-clockwise direction without any alteration or system recalibration required.

The signal then passes a capacitor 66, which charges to a level equal to that of the signal 18. The signal 18 then feeds to a second buffer 68, which feeds the signal 18 back to three points: the first buffer 60, through the second diode 62 to a point before the first diode 64, and back to the second buffer 68. The circuit 22 seeks to establish equilibrium of voltage. Thus, the output of the positive peak circuit portion 22 changes only if a higher input value is received by the circuit portion 22. Otherwise, the circuit will hold the highest charge previously passed therethrough. Means for clearing 70 the circuit 22 are included, so that different readings may be taken upon a new workpiece by clearing out the values from the previous workpiece.

The dual peak circuit generates a positive peak signal 26 and a negative peak signal 28. These signals 26, 28 are then fed to the converter 30, which converts these signals from analog to digital. Preferably, the converter 30 translates the signals 26, 28 to a 12 bit digital word, though other formats could be elected. The digital values are then passed onto a data bus 32, wherein the central processing unit 34 receives these values. The central processing unit 34 determines, by means commonly known in the art, where to store this data in the storage means 42, 44, and where to display this data on the display means 38. The central processing unit 34, the storage means 42, 44, the clock 46 and the display means 38 comprise the means for computing in the present invention.

The means for computing may further comprise a quadrature pulse decoder 40. Such devices are well known and are commercially available. The quadrature pulse decoder 40, by calculations based upon the input quadrature wave forms (not shown), as indicated by the input feed from the quadrature encoder 41, determine the angular disposition of the torquing tool. By determining this motion, greater accuracy in the torquing action can be achieved and monitored.

The computing means may further comprise a communication interface 36. The communication interface 36 allows the apparatus 10 to be connected to other computer devices (not shown). One such embodiment is a master-servant system, where a main computer could hold all threshold and maximum values for a work area or station. Individual workers could each use one copy of the present invention 10, with the readings being fed back into the computer for a central monitoring status.

Referring to FIG. 2, there is shown a torquing signal 90. The force of the torque encountered increases until the positive peak value is achieved. This sets the positive peak value 92, which is then stored on the capacitor 66 and later stored by the central processing unit 32. The torque signal 90 can then be reversed as the direction of the torque applied changes, although it would rarely be immediately reversed on a same joint. Rather, in an application such as a fire hydrant assembly, where different joints are tightened in different directions, an oppositely threaded fastener can be monitored without any worker recalibration. The negative peak circuit will begin tracking the torque signal 90 until the negative peak 94 is achieved on the oppositely threaded joint. This value is then stored on the capacitor 66 and the torque applied to the circuit levels off to zero, until a new joint is torqued.

Another less preferred embodiment of the present invention would be to include the capability of monitoring fastening device of the slip-type, which generate multiple torque spikes. One such method of achieving this is found in U.S. Pat. No. 4,715,211, issued to Lehoczky, which is incorporated herein by reference. Lehoczky teaches one method of measuring torque in such devices. The techniques of Lehoczky, or others similarly known in the art, can be combined with the present invention to produce a dual peak detection device to measure slip-type fastening devices which move in dual fastening directions.

Referring now to FIG. 1, the digital inputs 50 and digital outputs 52 are provided to allow the user to see data as it is produced and allows data not digitally feedable, such as that from a needle gauge or the like, to be entered by the user. Such devices for the input 50 and output 52 are of the type commonly known and commercially available.

Referring now to FIG. 4, there is seen a general view of the device 10 of the present invention. The device 10 is connected by a cord 86 to a tool 80, here shown as a wrench. Leads may be connected to the tool 80, such as those shown connected near the rear of the handle thereof 86. The lead 86 will then have the transducer contained in the head 84 thereof. The lead 86 then feeds the data to the unit 10. It is then fed to the circuit, as is consistent with the description hereinabove.

It will be understood that the foregoing description is illustrative of the preferred embodiment of the present invention and is not be understood to be restrictive to only those details enumerated herein. Variations and substitutions that occur to those of skill in this art field are included in the scope of this disclosure, as are the advantages inherent to the embodiments disclosed.

Having thus described the present invention, what is claimed is:

1. An apparatus for measuring the torque being applied to a fastener at a joint regardless of the direction of fastening, the apparatus comprising:

(a) a transducer to provide an analog signal corresponding to the amount of torque being applied to a fastener;

(b) an analog dual peak detector circuit in electrical communication with the transducer which receives the analog signal from the transducer to determine the maximum torque being applied to a fastener regardless of the direction of the fastening;

(c) a converter in electrical communication with the analog dual peak detector circuit to change the signal from analog to digital;

(d) means for storing peak values; and (e) means for displaying peak values.

2. The apparatus of claim 1, wherein the dual peak detector circuit comprises:

(a) a positive peak portion; and (b) a negative peak portion;

each portion of the circuit receiving the analog signal from the transdeucer, wherein positive portion of the circuit measures torque applied in a clockwise direction and the negative portion measures torque applied in a counter-clockwise direction.

3. A method of measuring torque being applied to a fastener at a joint regardless of the direction of fastening, the method comprising the steps of:

(a) generating an analog signal representing the torque being applied to the fastener;

(b) determining the peak value of the torque being applied by passing the analog signal through an analog dual peak detection circuit;

(c) converting the analog signal and the peak values determined into digital values;

(d) storing the digital values in means for storing; and (e) displaying the digital values on means for displaying.

4. The method of claim 3, further comprising the step of:

(a) auditing the torque previously applied to the fastener.

5. An apparatus for measuring torque being applied to a fastener at a joint regardless of the direction of fastening, the apparatus comprising:

(a) a transducer configured to provide an analog signal corresponding to the amount of torque being applied to a fastener;

(b) an analog dual peak detector circuit in electrical communication with the transducer, the analog dual peak detector circuit comprising:

(i) a pair of buffers configured to receive the analog signal;

(ii) means for evaluating the magnitude of the analog signal received at each of the pair of buffers;

(iii) means for establishing a voltage indicative of the greatest magnitude of the analog signal received at each of the pair of buffers;

(c) an analog to digital converter in electrical communication with the analog dual peak detector circuit configured to change a voltage indicative of the greatest magnitude of the analog signal into a digital signal;

(d) means for storing a digital signal.

6. The apparatus of claim 5 further comprising a filter disposed intermediate and in electrical communication with the transducer and the analog dual peak detector circuit, the filter configured to provide a clearer single-ended electrical signal.

7. The apparatus of claim 6 further comprising a plurality of amplifiers disposed intermediate and in electrical communication with the transducer and the filter.

8. The apparatus of claim 5 wherein the analog dual peak detector circuit further comprises means for resetting the analog dual peak detector circuit.

9. The apparatus of claim 5 further including means for displaying a value indicative of a digital signal stored in the means for storing a digital signal.

10. The apparatus of claim 1, wherein the circuit comprises a capacitor across which the torque is measured.

* * * * *